US011268216B2

(12) United States Patent
Duralti et al.

(10) Patent No.: US 11,268,216 B2
(45) **Date of Patent: *Mar. 8, 2022**

(54) YARN-TENSION INFLUENCING DEVICE FOR A TWISTING OR CABLING MACHINE

(71) Applicant: Saurer Technologies GmbH & Co. KG, Krefeld (DE)

(72) Inventors: Cenk Duralti, Mönchengladbach (DE); Ingo Filz, Viersen (DE); Sergei Singer, Krefeld (DE); Georg Tetzlaff, Aachen (DE)

(73) Assignee: Saurer Technologies GmbH & Co. KG, Krefeld (DE)

( * ) Notice: Subject to any disclaimer, the term of this patent is extended or adjusted under 35 U.S.C. 154(b) by 307 days.

This patent is subject to a terminal disclaimer.

(21) Appl. No.: 16/516,470

(22) Filed: Jul. 19, 2019

(65) Prior Publication Data

US 2020/0024775 A1 Jan. 23, 2020

(30) Foreign Application Priority Data

Jul. 20, 2018 (DE) ..... 10 2018 005 732.2

(51) Int. Cl.
*D01H 13/10* (2006.01)
*D01H 13/26* (2006.01)

(52) U.S. Cl.
CPC ..... *D01H 13/104* (2013.01); *D01H 13/26* (2013.01)

(58) Field of Classification Search
CPC ..... D01H 13/00; D01H 13/01; D01H 13/104; D01H 13/106; D01H 13/108; D01H 13/12;

(Continued)

(56) References Cited

U.S. PATENT DOCUMENTS 3,277,640 A * 10/1966 Colombu ..... B65H 59/384 57/62
3,685,765 A * 8/1972 Takizawa ..... D01H 13/18 242/147 R (Continued)

FOREIGN PATENT DOCUMENTS

DE 10 2011 111 725 A1 2/2013

*Primary Examiner* — Shaun R Hurley
*Assistant Examiner* — Bao-Thieu L Nguyen
(74) *Attorney, Agent, or Firm* — Nelson Mullins Riley & Scarborough LLP

(57) ABSTRACT

Yarn-tension influencing device for a twisting or cabling machine for feeding a yarn via a traversing yarn guide to a take-up package, the yarn-tension influencing device having a first deflection roller, arranged downstream of a yarn handling device in the yarn transport direction and is provided for guiding the yarn from a balloon yarn guide through the yarn handling device and for deflecting the yarn; a second deflection roller, arranged downstream of the first deflection roller in the yarn transport direction and is provided for further deflection of the yarn; a third deflection roller, arranged downstream of the second deflection roller in the yarn transport direction and is provided for adjusting the angle of wrap of the yarn around an advance roller; and an advance roller, arranged downstream of the third deflection roller in the yarn transport direction and is provided for regulating the yarn tension. The yarn handling device is a yarn clamping and cutting device, and a sensor device is provided for monitoring the yarn, the second deflection roller being arranged on a plane different from a horizontal plane formed by the axis of rotation of the first deflection roller.

9 Claims, 3 Drawing Sheets

(58) Field of Classification Search
CPC ..... D01H 13/14; D01H 13/145; D01H 13/16; D01H 13/1608; D01H 13/1616; D01H 13/1625; D01H 13/1633; D01H 13/1641; D01H 13/165; D01H 13/1658; D01H 13/1666; D01H 13/1675; D01H 13/1683; D01H 13/1691; D01H 13/18; D01H 13/181–183; D01H 13/185–188; D01H 13/20; D01H 13/22; D01H 13/24; D01H 13/26; D01H 13/28; D01H 13/30; D01H 13/302; D01H 13/304; D01H 13/306; D01H 13/308; D01H 13/32
See application file for complete search history.

(56) References Cited

U.S. PATENT DOCUMENTS 4,023,341 A * 5/1977 Saino ..... D01H 13/1633 57/81
4,346,551 A * 8/1982 Yanobu ..... B65H 59/10 242/155 R
4,356,692 A * 11/1982 Karl ..... B65H 51/205 57/263
4,526,329 A * 7/1985 Takeda ..... B65H 59/16 242/155 M
4,947,633 A * 8/1990 Stahlecker ..... B65H 54/026 242/472.8
5,163,279 A * 11/1992 Stahlecker ..... B65H 54/026 57/261
5,619,848 A * 4/1997 Costales ..... D01H 13/26 57/261
5,799,476 A * 9/1998 Bahlmann ..... B65H 63/00 57/264
6,092,356 A * 7/2000 Stahlecker ..... D01H 4/16 57/400
8,650,849 B2 * 2/2014 Pede-Vogler ..... D01H 13/106 57/58.86
10,954,098 B2 * 3/2021 Diepolder ..... B65H 51/12
2009/0199631 A1 * 8/2009 Straaten ..... D01H 13/26 73/160
2017/0350041 A1 * 12/2017 Pede-Vogler ..... D01H 1/10
2019/0010632 A1 * 1/2019 Yang ..... D01H 13/02
2020/0216985 A1 * 7/2020 Kappeler ..... D01H 5/60
2021/0156052 A1 * 5/2021 Kappeler ..... D01H 1/14

* cited by examiner

YARN-TENSION INFLUENCING DEVICE FOR A TWISTING OR CABLING MACHINE

CROSS-REFERENCE TO RELATED APPLICATION

This application claims priority from German National Patent Application No. 10 2018 005 732.2, filed Jul. 20, 2018, entitled "Fadenspannungsbeeinflussungseinrichtung für eine Zwirn-oder Kabliermaschine", the entire contents of which are incorporated herein by reference.

FIELD OF THE INVENTION

The invention relates to a yarn-tension influencing device for a twisting or cabling machine, a workstation of a twisting or cabling machine comprising such a yarn-tension influencing device, and a twisting or cabling machine comprising such a workstation.

BACKGROUND OF THE INVENTION

German Patent Publication DE 10 2011 111 725 A1 describes textile machines and in particular twisting and cabling machines that feature a friction roller for frictionally driving a cross-wound package as well as a yarn processing device in the form of an advance roller upstream of the friction roller in the yarn path. According to German Patent Publication DE 10 2011 111 725 A1, the textile machine has at least one drive shaft extending in the longitudinal direction, to which the yarn processing devices are each connected by means of an endless traction element, the drive shaft being equipped with a plurality of drive devices for guiding and driving a corresponding endless traction element. Because of a special arrangement of the endless traction element and deflection and guide grooves on the bearing shaft of the advance roller, which advance roller is supported on one side, the endless traction element can be easily exchanged without trouble if required.

By means of the advance roller, which usually consists of a pair of serrated discs, the twisted or cabled yarn is fed to a traversing yarn guide, which winds the yarn onto a take-up package with oscillating movements. The advance roller reduces the pretension of the yarn before the winding procedure. A deflection roller, which can be pivoted about the same axis of rotation about which the advance roller rotates, is associated with the advance roller. By means of the deflection roller, the angle of wrap of the yarn around the advance roller can be increased or decreased. Accordingly, a greater decrease in the yarn tension is effected in the case of a greater angle of wrap and a lesser decrease in the yarn tension is effected in the case of a lesser angle of wrap. By reducing the pretension of the yarn, the package build of the cross-wound package can be improved.

In practice, what is referred to as a pneumatic differential yarn feeler and further deflection rollers are usually arranged upstream of the advance roller. The differential yarn feeler monitors the running yarn with respect to a tension drop and cuts the yarn if necessary. The differential yarn feeler is centrally pneumatically adjusted for each machine side before the start of the twisting process. The deflection rollers ensure that the yarn coming from the balloon yarn guide is first guided through the differential yarn feeler and is subsequently fed to the deflection roller arranged upstream of the advance roller. It is difficult for the operating personnel to manually yarn in the yarn in the region of the yarn-tension influencing device between the balloon yarn guide and the winding mechanism.

The yarn is guided meanderingly between the serrated discs. The circumferential speed is higher than the winding speed. More or less tension is decreased depending on the angle of wrap around the advance roller.

SUMMARY OF THE INVENTION

The terms "yarn" and "thread" may be used interchangeably in the context of the present invention.

A first aspect of the invention therefore relates to a yarn-tension influencing device for a twisting or cabling machine for feeding a yarn via a traversing yarn guide to a take-up package, comprising: a first deflection roller, which is arranged downstream of a yarn handling device in the yarn transport direction and is provided for guiding the yarn from a balloon yarn guide through the yarn handling device and for deflecting the yarn; a second deflection roller, which is arranged downstream of the first deflection roller in the yarn transport direction and is provided for further deflection of the yarn; a third deflection roller, which is arranged downstream of the second deflection roller in the yarn transport direction and is provided for adjusting the angle of wrap of the yarn around an advance roller; and an advance roller, which is arranged downstream of the third deflection roller in the yarn transport direction and is provided for regulating the yarn tension.

The yarn-tension influencing device is characterized in that the yarn handling device arranged upstream of the first deflection roller in the yarn transport direction is a yarn clamping and cutting device, and that a sensor device, which is arranged downstream of the first deflection roller in the yarn transport direction, is provided for monitoring the yarn, the second deflection roller being arranged on a plane different from a horizontal plane formed by the axis of rotation of the first deflection roller.

Because of the separate arrangement of a yarn cutting and clamping device and the sensor device, wherein the sensor device can be arranged either between the first and second deflection rollers or between the second and third deflection rollers, a greater distance between the deflection rollers is achieved. Furthermore, because the first and second deflection rollers are arranged on different horizontal planes, less sharp changes in direction are necessary in the hand movement for yarning in. This simplifies handling overall for the operating personnel because the movement sequence for manual yarning in enables smoother and more harmonious hand movement.

In the sense of the invention, the statement that the second deflection roller is arranged on a plane different from a horizontal plane formed by the axis of rotation of the first deflection roller should be understood to mean that the deflection rollers, lying on planes formed by the respective axes of rotation, can be arranged differently. A parallel, vertical arrangement of the axes of rotation of the deflection rollers is just as conceivable as an oblique arrangement, the oblique arrangement containing any angle from the vertical parallel arrangement to 15° with respect to the horizontal plane formed by the axis of rotation of the first deflection roller.

Previously, the first and second deflection rollers were arranged nearly on a horizontal plane and at a relatively small distance between axes, and therefore it was more difficult for the operating personnel to properly yarn in the yarn.

At the same time, by means of the yarn sensor, which can be centrally electronically adjusted for each machine side, it is ensured that, if a yarn tension sensor is used, a tension drop or an overload of the yarn is reliably detected, for example. As soon as a tension drop or an overload is recognized, the yarn clamping and cutting device is triggered in such a way that the remaining second yarn is clamped and cut. Within the scope of the invention, an optical sensor, for example, can also be used, which detects a missing yarn and/or a single yarn. The signal of the yarn sensor can additionally initiate an error indication, for example in the form of an optically perceivable error indication by means of a signal lamp at the workstation, a spindle stop and/or a take-up roller stop.

The advantages that are achieved by means of an advance means supported on one side are further optimized by means of the arrangement of the individual constituent parts according to the invention, and the compact and laterally open design of the yarn guidance thereby achieved improves the accessibility and the visibility of the yarn-tension influencing device. The yarn path can be viewed, which excludes the possibility of wrapping errors. It is thus also ensured that the yarn path is the same at each workstation. An identical decrease in tension is thereby achieved at all the workstations, which ultimately benefits the product quality.

In an advantageous configuration, the deflection rollers, the yarn clamping and cutting device, the sensor device and the advance roller are arranged on a housing of the yarn-tension influencing device.

By integrating all the constituent parts into the assembly of the yarn-tension influencing device, a compact assembly enabling simpler handling overall for the operating personnel is achieved. Furthermore, older workstations already in use or complete twisting and cabling machines can also be retrofitted with such a component.

Preferably, a protection cap at least partially covering the advance roller is detachably fastened to the housing.

The advance roller comprises a pair of serrated discs, between which the yarn is guided meanderingly. In order to protect this region and to mitigate a source of hazard for the operating personnel, a protection cap is detachably arranged on the housing. The protection cap can be easily removed in order to remove a yarn coil from/out of the advance roller or to exchange the advance roller. For example, fastening of the protection cap by means of at least one screw is conceivable, but other detachable fastening options are also conceivable within the scope of the invention.

The sensor device is advantageously arranged upstream of the second deflection roller.

If the sensor device is arranged between the first and second deflection rollers, a distance is generated particularly between these two deflection rollers, which distance enables simpler handling. Because the two deflection rollers are furthermore arranged on different horizontal planes formed by the axes of rotation of these deflection rollers, manual handling is further optimized.

If the sensor device is moreover arranged in such a way that the measurement slot is accessible from the front when the yarn-tension influencing device is viewed from above, the yarn to be yarned in automatically slides into the measurement slot when guided over the deflection rollers.

In another preferred formation of the invention, the angle of a straight line through the axes of rotation of the first and second deflection rollers with respect to the horizontal plane of the axis of rotation of the first deflection roller is between 15° and 75°.

In tests, it was determined that an angle of between 15° and 75° is particularly advantageous. The sensor device is positioned in accordance with the selected angle.

In an advantageous formation, the advance roller can be driven by a continuous central shaft by means of a belt and can be uncoupled by means of a switchable clutch.

As is known from the prior art, in the case that the advance roller is supported on one side, driving is accomplished by a central shaft by means of an endless traction element, while the advance roller is adapted at the other end. Previously, for safety reasons the serrated discs of the advance means were fastened to the shaft using overload slip clutches and the yarn-tension influencing device was protected by means of covers. In order to be able to remove a yarn coil on the advance means, the entire machine side had to be shut down for safety reasons. Because of the combination of such a drive with a switchable clutch, after the yarn sensor has detected a tension drop or yarn break, a signal is additionally generated, on the basis of which the advance roller of the workstation in question is stopped. Thus, for example, a yarn coil that has formed can be safely removed without having to shut down the entire machine side.

When the advance roller is not driven, the yarns can be inserted into the operative region of the advance roller even during the starting process without a risk of coils. As a result, the start handling procedure is likewise safer and simpler. There is also no longer a risk of injury when placing the yarn into a continuously rotating advance means.

In addition, because of the switchable clutch, it is possible to drive the advance roller only at the workstations at which the twisting process is being performed. That is, if not all the workstations should be operated during the twisting process, the advance roller is driven only at the workstations that are producing a twisted yarn; at unoccupied workstations, the advance roller is not driven.

In another alternative configuration, the advance roller can be motor-driven.

If the advance roller is directly driven by a single motor or the motor drive is transferred to the advance roller by means of a transmission element, not only can the advantages already described be achieved, but also every advance roller can be driven at a separately controlled speed, affecting both the angle of wrap and the regulation of the tension of the yarn to be wound.

A second aspect of the invention therefore relates to a workstation of a twisting or cabling machine for winding a yarn via a traversing yarn guide onto a take-up package, having a yarn-tension influencing device comprising: a first deflection roller, which is arranged downstream of a yarn handling device in the yarn transport direction and is provided for guiding the yarn from a balloon yarn guide through the yarn handling device and for deflecting the yarn; a second deflection roller, which is arranged downstream of the first deflection roller in the yarn transport direction and is provided for further deflection of the yarn; a third deflection roller, which is arranged downstream of the second deflection roller in the yarn transport direction and is provided for adjusting the angle of wrap of the yarn around an advance roller; and an advance roller, which is arranged downstream of the third deflection roller in the yarn transport direction and is provided for regulating the yarn tension.

The workstation is characterized in that the yarn-tension influencing device is formed by a yarn-tension influencing device according to one of the embodiments described above.

If the workstation is equipped with such a yarn-tension influencing device, this has a positive effect on the package build of the take-up package and handling is made easier for the operating personnel.

In particular, handling during yarning in is made easier and simpler for the operating personnel. Because of the improved lateral accessibility together with the improved visibility, the yarn path can be more easily checked at any time by the operating personnel, and thus errors caused by improper wrapping around the individual deflection rollers are minimized.

A third aspect of the invention therefore relates to a twisting or cabling machine having a plurality of workstations, for winding a yarn via a traversing yarn guide onto a take-up package, having a yarn-tension influencing device comprising: a first deflection roller, which is arranged downstream of a yarn handling device in the yarn transport direction and is provided for guiding the yarn from a balloon yarn guide through the yarn handling device and for deflecting the yarn; a second deflection roller, which is arranged downstream of the first deflection roller in the yarn transport direction and is provided for further deflection of the yarn; a third deflection roller, which is arranged downstream of the second deflection roller in the yarn transport direction and is provided for adjusting the angle of wrap of the yarn around an advance roller; and an advance roller, which is arranged downstream of the third deflection roller in the yarn transport direction and is provided for regulating the yarn tension.

The twisting or cabling machine is characterized in that at least one workstation is formed by a workstation according to the embodiment described above.

Overall, the machine operation is made easier for the personnel in the case of a twisting or cabling machine formed in such a way, and this also has a positive effect on the efficiency of the entire twisting or cabling machine. Because one person usually looks after numerous machines each having a plurality of workstations, time and effort are saved when work steps are easier to perform.

Furthermore, because of the simplified yarn guidance and the simplified yarning in of the yarn, error sources resulting from improper positioning of the yarn in the yarn-tension influencing device are reduced.

Because the previously used pneumatic differential yarn feeler, which was arranged upstream of the first deflection roller and sensed the yarn tension according to a weighing beam principle and also contained a yarn clamping and cutting device, is omitted, the compressed-air system required for this purpose is also eliminated, and this has a positive effect on the production costs of the twisting or cabling machine.

Further features and advantages of the invention are evident from the following description of preferred embodiment examples of the invention, on the basis of the figures and drawings illustrating details essential to the invention, and from the patent claims. The individual features can be implemented individually or in any desired combination in a preferred embodiment of the invention.

BRIEF DESCRIPTION OF THE DRAWINGS

Preferred embodiment examples of the invention are explained in more detail below on the basis of the enclosed drawings.

DESCRIPTION OF THE PREFERRED EMBODIMENTS

The following description of the embodiments of the present invention is merely exemplary in nature and is in no way intended to limit the invention, its application, or uses. The following description is provided herein solely by way of example for purposes of providing an enabling disclosure of the invention, but does not limit the scope or substance of the invention.

Figure 1:
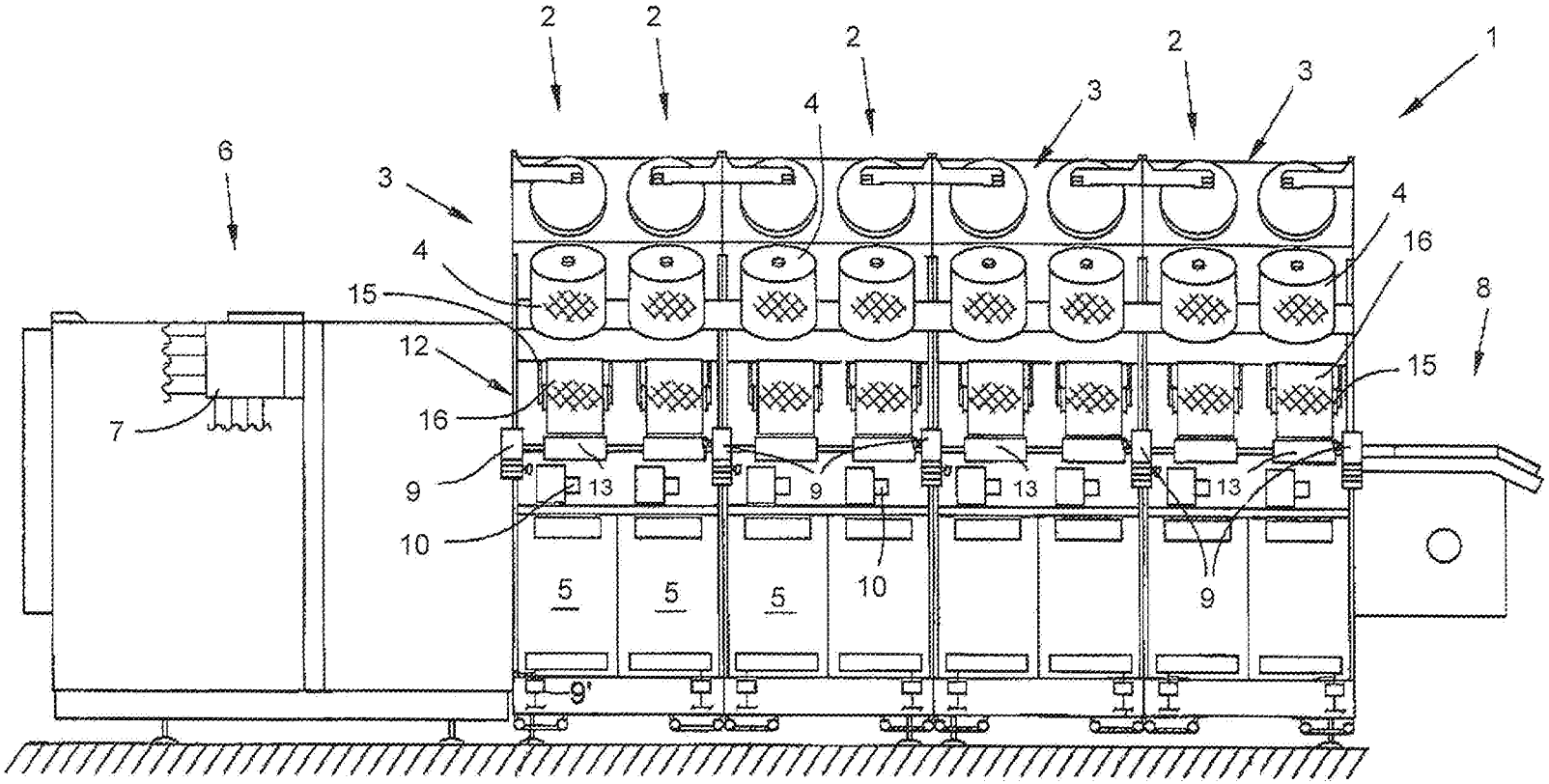
FIG. 1 is a schematic front view of a twisting or cabling machine, the workstations of which are equipped with the yarn-tension influencing device according to the invention.

FIG. 1 shows a schematic front view of a twisting or cabling machine 1. Such textile machines each have a plurality of identical workstations 2 in the region of the machine longitudinal sides of such textile machines.

Such textile machines also generally feature a drive and operating unit 6 arranged at a machine end, in which drive and operating unit 6 for example the necessary energy devices, various drives and a central control device 7 are installed.

In the embodiment example, the twisting or cabling machine 1 also has a package transport system, the schematically illustrated delivery point of which is labelled with reference number 8.

As is known, the workstations 2 of twisting or cabling machines 1 with outer yarn feeding each feature a creel 3, which serves to hold at least one first feed package 4, from which what is referred to as an outer yarn is drawn.

Such workstations 2 also each have a spindle driven by a spindle drive (for better clarity, this is not shown in greater detail in the figures of the present application). Such a spindle drive can be a motor that directly drives the spindle or can be an indirect drive, for example a belt drive.

As usual, the spindle, which in the embodiment example of FIG. 1 is arranged behind a movably mounted protection wall 5, additionally bears, on a stationary spindle pot bottom arranged on the spindle, a second feed package, from which what is referred to as an inner yarn is drawn from above, which inner yarn is fed above the spindle to a balloon yarn guide 18.

The outer yarn is drawn from the first feed package 4, which is stored in the creel 3, and in this embodiment example is fed further via a creel yarn brake 9 and subsequently circles around the spindle, thus forming a free yarn balloon. The balloon yarn guide 18, in which the outer yarn drawn from the first feed package 4 and the inner yarn drawn from the second feed package are brought together, determines the height of the free yarn balloon that is formed. The twisting point, at which the outer yarn and the inner yarn merge, is located in this device, which is also referred to as a balancing system.

The yarn-tension influencing device 10, by means of which the twisted yarn 17 is fed via the advance roller 11 to a winding device 12, is arranged above the twisting point.

As usual, the winding device 12 has a drive roller 13 and a traversing yarn guide 14. By means of the traversing yarn guide 14, the yarn is wound onto a take-up package 16, which is frictionally driven by the drive roller 13 and is held in a package cradle 15.

Figure 2:
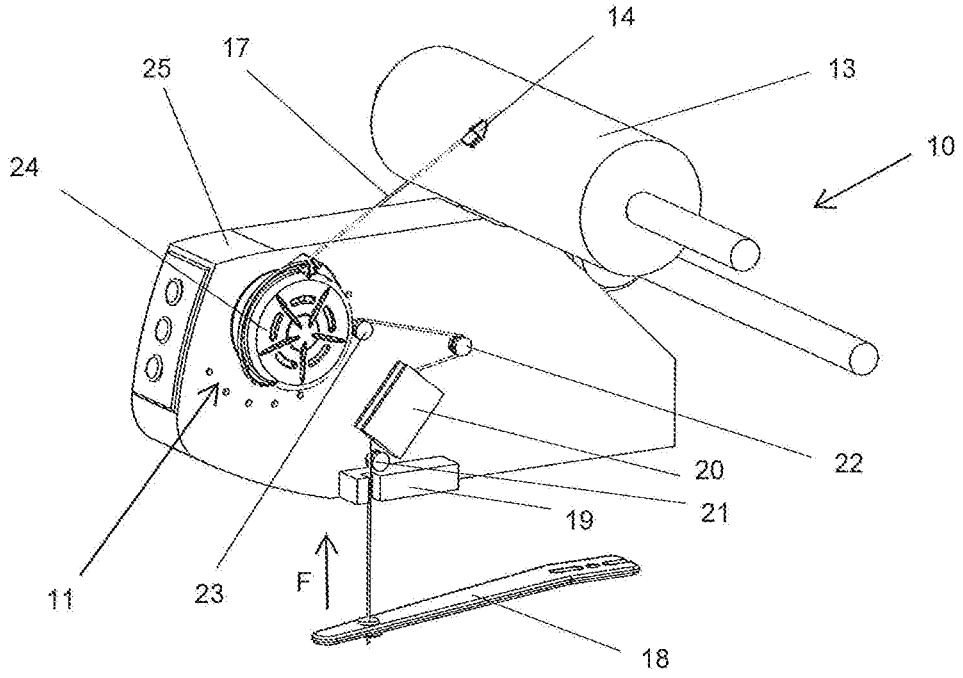
FIG. 2 is a schematic illustration of the yarn-tension influencing device according to the invention.

FIG. 2 shows a yarn-tension influencing device 10 according to the invention. The yarn 17 is fed through the balloon yarn guide 18 in the yarn transport direction F to a first deflection roller 21, the yarn 17 passing through a yarn clamping and cutting device 19 in the process. From the first deflection roller 21, the yarn 17 is guided toward a second deflection roller 22, the yarn 17 passing through a sensor device 20 in the process. From the second deflection 22, the yarn 17 reaches the advance roller 11 via a third deflection roller 23.

As schematically arranged in FIG. 2, the third deflection roller 23 can be manually positioned in different positions, as is known and therefore not explained in greater detail here, so that the yarn 17 runs onto the advance roller 11 with different angles of wrap. That is, a greater decrease in the yarn tension occurs in the case of a greater angle of wrap and a lesser decrease in the yarn tension occurs in the case of a lesser angle of wrap.

From the advance roller 11, the yarn 17 is wound, via a traversing yarn guide 14 with oscillating movements, onto a take-up package 16, which is rotated by means of the drive roller 13.

Moreover, a protection cap 24 is mounted on the housing 25 of the yarn-tension influencing device 10, the rotating advance roller 11 thereby being at least partially covered.

FIG. 2 also shows that an operating and indicating field having function buttons is arranged on the front side of the housing 25 of the yarn-tension influencing device 10. By means of the operating and indicating field, the yarn-tension influencing device 10 can be put into and taken out of operation, for example.

Figure 3:
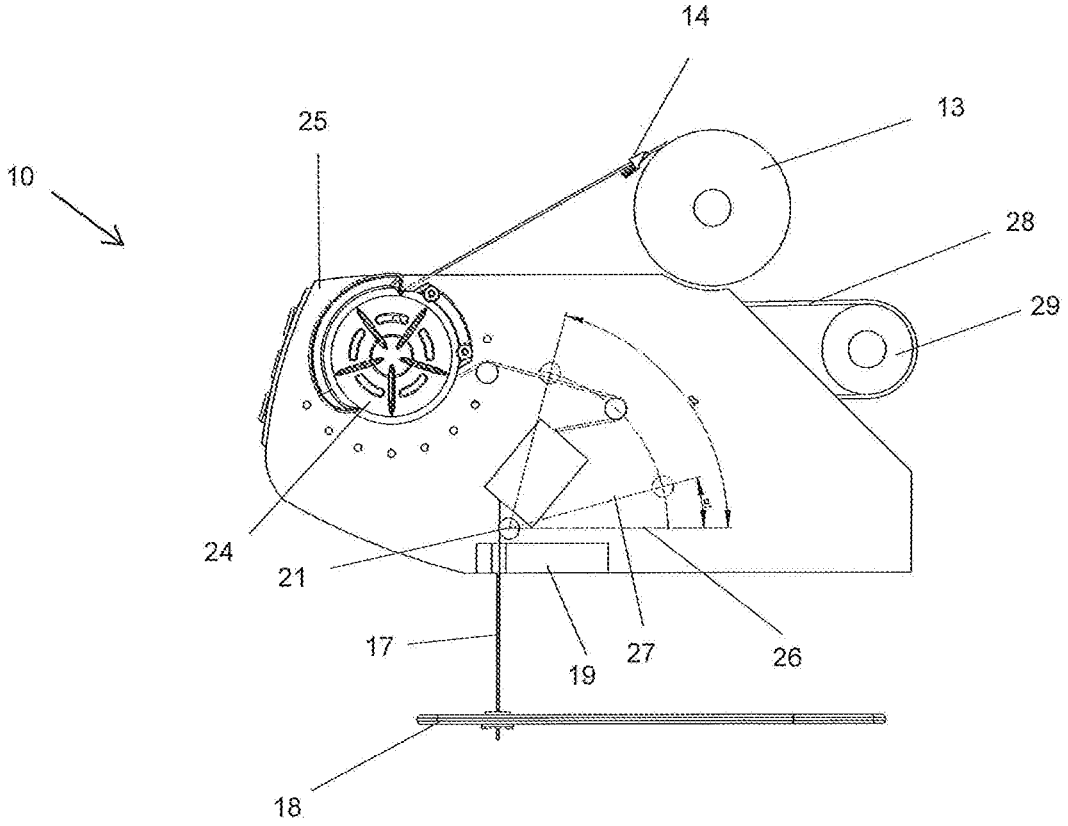
FIG. 3 is a schematic illustration of the yarn-tension influencing device according to the invention from FIG. 2 in a side view.

FIG. 3 shows the yarn-tension influencing device 10 from FIG. 2 in a side view. By means of a belt 28, the advance roller 11 is driven by a central shaft 29 arranged over the length of the machine.

Moreover, FIG. 3 shows an advantageous range of the angle of a straight line 27, which angle is formed by the axes of rotation of the first deflection roller 21 and of the second deflection roller 22 with respect to the horizontal plane 26 formed by the axis of rotation of the first deflection roller 21. The angle labelled with $\alpha 1$ is 15°, while the angle labelled with $\alpha 2$ is 75°.

Figure 4:
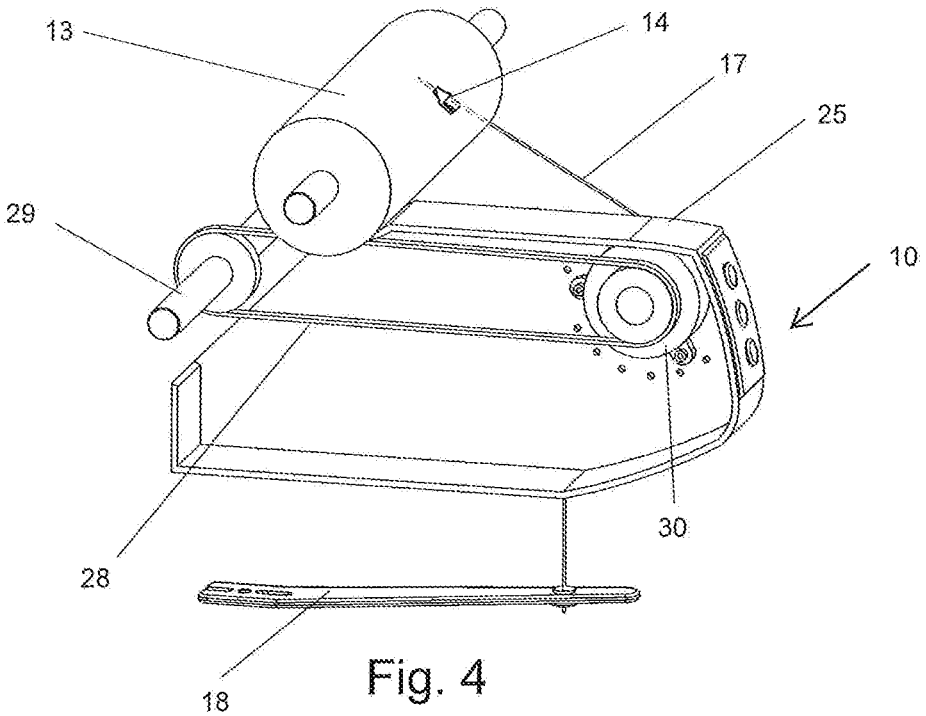
FIG. 4 is a schematic illustration of the yarn-tension influencing device according to the invention, wherein the advance roller is driven by a central shaft and has an electrically switchable clutch.

FIG. 4 shows an embodiment example of the yarn-tension influencing device 10 in which the advance roller 11 is driven by a central shaft 29 by means of a belt 28. A clutch, which is formed as a disc clutch here, is labelled with reference number 30. The flange of the clutch housing is fastened at fastening points in the housing 25 of the yarn-tension influencing device 10.

By means of such a switchable clutch 30, it is possible, for example in the event of a yarn coil, to uncouple the advance roller 11 from the driving central shaft 29, i.e. the front disc of the clutch 30 continues to rotate after the uncoupling but the rotation is no longer transferred to the advance roller 11, which thus comes to a standstill. Because clutches 30 are known per se and are not a subject of the invention, a detailed description is not provided here.

Figure 5:
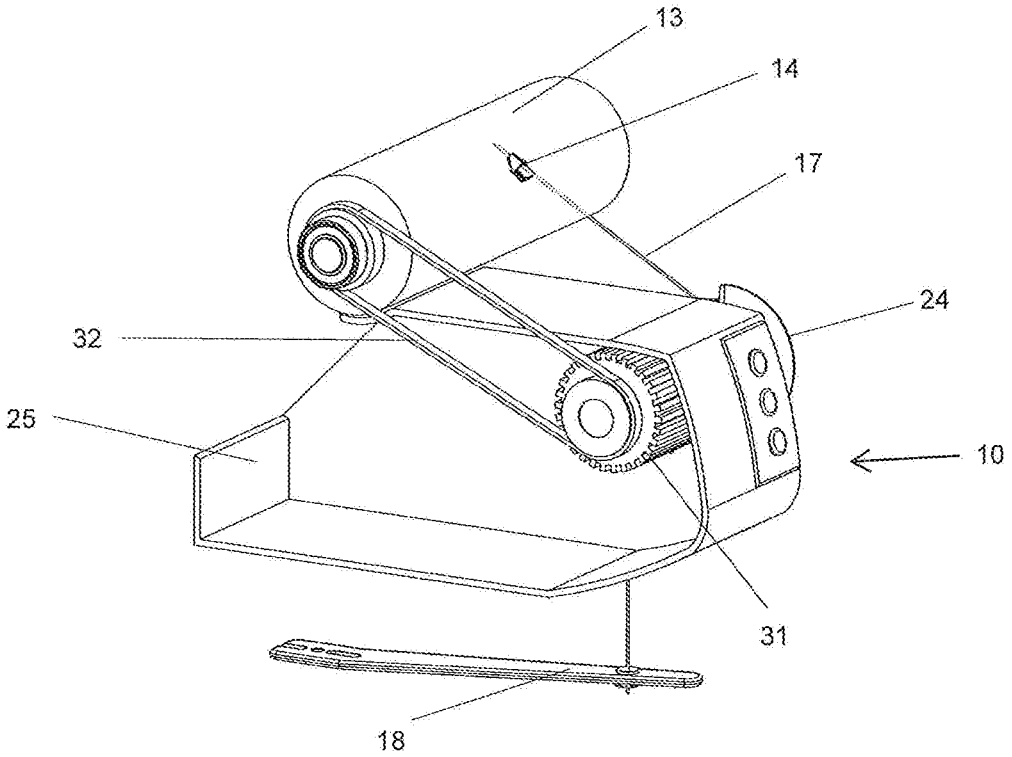
FIG. 5 is a schematic illustration of the yarn-tension influencing device according to the invention, wherein the advance roller is motor-driven.

FIG. 5 shows an alternative embodiment example in which the advance roller 11 is driven by a single motor. In the housing 25 of the yarn-tension influencing device 10, there is a motor 31, which directly drives the advance roller 11. By means of a transmission element 32, formed as a belt here, the drive roller 13 is additionally driven by the motor 31. In the event of a drop in the tension of the yarn 17 or a yarn break, the motor 31 is stopped and the advance roller 11 stops rotating. Thus, for example, a yarn coil that has occurred can be safely removed without the advance rollers 11 of the other workstations 2 also having to be shut down.

LIST OF REFERENCE NUMBERS

1 Twisting or cabling machine
2 Workstations
3 Creel
4 Feed package
5 Protection wall
6 Drive and operating unit
7 Control device
8 Delivery point
9 Creel yarn brake
10 Yarn-tension influencing device
11 Advance roller
12 Winding device
13 Drive roller
14 Traversing yarn guide
15 Package cradle
16 Take-up package
17 Yarn
18 Balloon yarn guide
19 Yarn clamping and cutting device
20 Sensor device
21 First deflection roller
22 Second deflection roller
23 Third deflection roller
24 Protection cap
25 Housing
26 Horizontal plane
27 Straight line
28 Belt
29 Central shaft
30 Clutch
31 Motor
32 Transmission element It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A yarn-tension influencing device for a twisting or cabling machine for feeding a yarn via a traversing yarn guide to a take-up package, the yarn-tension influencing device comprising:

a first deflection roller, which is arranged downstream of a yarn handling device in the yarn transport direction and is provided for guiding the yarn from a balloon yarn guide through the yarn handling device and for deflecting the yarn;

a second deflection roller, which is arranged downstream of the first deflection roller in the yarn transport direction and is provided for further deflection of the yarn;

a third deflection roller, which is arranged downstream of the second deflection roller in the yarn transport direction and is provided for adjusting the angle of wrap of the yarn around an advance roller; and an advance roller, which is arranged downstream of the third deflection roller in the yarn transport direction and is provided for regulating the yarn tension, characterized in that the yarn handling device, which is arranged upstream of the first deflection roller in the yarn transport direction, is a yarn clamping and cutting device and that a sensor device, which is arranged downstream of the first deflection roller in the yarn transport direction, is provided for monitoring the yarn, the second deflection roller being arranged on a plane different from a horizontal plane formed by the axis of rotation of the first deflection roller.

2. The yarn-tension influencing device according to claim 1, characterized in that the deflection rollers, the yarn clamping and cutting device, the sensor device and the advance roller are arranged on a housing of the yarn-tension influencing device.

3. The yarn-tension influencing device according to claim 2, characterized in that a protection cap is detachably fastened to the housing, which protection cap at least partially covers the advance roller.

4. The yarn-tension influencing device according to claim 1, characterized in that the sensor device is arranged upstream of the second deflection roller.

5. The yarn-tension influencing device according to claim 4, characterized in that an angle of a straight line through axes of rotation of the first and second deflection rollers with respect to the horizontal plane of an axis of rotation of the first deflection roller is between 15° and 75°.

6. The yarn-tension influencing device according to claim 1, characterized in that the advance roller can be driven by a continuous central shaft by means of a belt and can be uncoupled by means of a switchable clutch.

7. The yarn-tension influencing device according to claim 1, characterized in that the advance roller can be motor-driven.

8. A workstation of a twisting or cabling machine, for winding a yarn via a traversing yarn guide onto a take-up package, having a yarn-tension influencing device comprising:

a first deflection roller, which is arranged downstream of a yarn handling device in the yarn transport direction and is provided for guiding the yarn from a balloon yarn guide through the yarn handling device and for deflecting the yarn;

a second deflection roller, which is arranged downstream of the first deflection roller in the yarn transport direction and is provided for further deflection of the yarn;

a third deflection roller, which is arranged downstream of the second deflection roller in the yarn transport direction and is provided for adjusting the angle of wrap of the yarn around an advance roller; and an advance roller, which is arranged downstream of the third deflection roller in the yarn transport direction and is provided for regulating the yarn tension, characterized in that the yarn handling device, which is arranged upstream of the first deflection roller in the yarn transport direction, is a yarn clamping and cutting device and that a sensor device, which is arranged downstream of the first deflection roller in the yarn transport direction, is provided for monitoring the yarn, the second deflection roller being arranged on a plane different from a horizontal plane formed by the axis of rotation of the first deflection roller.

9. A twisting or cabling machine having a plurality of workstations, for winding a yarn via a traversing yarn guide onto a take-up package, having a yarn-tension influencing device comprising: a first deflection roller, which is arranged downstream of a yarn handling device in the yarn transport direction and is provided for guiding the yarn from a balloon yarn guide through the yarn handling device and for deflecting the yarn; a second deflection roller, which is arranged downstream of the first deflection roller in the yarn transport direction and is provided for further deflection of the yarn; a third deflection roller, which is arranged downstream of the second deflection roller in the yarn transport direction and is provided for adjusting the angle of wrap of the yarn around an advance roller; and an advance roller, which is arranged downstream of the third deflection roller in the yarn transport direction and is provided for regulating the yarn tension, characterized in that at least one workstation is formed by a workstation according to claim 8.

* * * * *